US006772479B2

(12) United States Patent
Hinkley et al.

(10) Patent No.: US 6,772,479 B2
(45) Date of Patent: Aug. 10, 2004

(54) CONDUCTIVE SHAPE MEMORY METAL DEPLOYMENT LATCH HINGE

(75) Inventors: David A. Hinkley, La Mirada, CA (US); Edward J. Simburger, Agoura, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 09/886,416

(22) Filed: Jun. 21, 2001

(65) Prior Publication Data

US 2002/0194702 A1 Dec. 26, 2002

(51) Int. Cl.[7] ..... E05D 1/00
(52) U.S. Cl. ..... 16/225; 16/372; 16/385
(58) Field of Search ..... 16/225, 226, 385, 16/DIG. 13, 372; 244/173; 52/645, 646, 648.1; 623/1.2, 1.18, 1.17; 403/404

(56) References Cited

U.S. PATENT DOCUMENTS 4,432,609 A * 2/1984 Dueker et al. ..... 359/236
4,787,580 A * 11/1988 Ganssle ..... 244/173
5,035,530 A * 7/1991 Fukuda et al. ..... 403/404
5,196,857 A * 3/1993 Chiappetta et al. ..... 343/881
5,272,486 A * 12/1993 Dickinson ..... 343/719
5,520,747 A * 5/1996 Marks ..... 136/245
5,545,210 A * 8/1996 Hess et al. ..... 128/898
5,620,529 A * 4/1997 Bassily et al. ..... 136/245
5,785,280 A * 7/1998 Baghdasarian ..... 244/173
5,922,020 A * 7/1999 Klein et al. ..... 623/1.15
6,175,989 B1 * 1/2001 Carpenter et al. ..... 16/225
6,321,503 B1 * 11/2001 Warren ..... 52/658
6,376,971 B1 * 4/2002 Pelrine et al. ..... 310/363
6,393,765 B1 * 5/2002 Goldstein et al. ..... 49/475.1
6,543,110 B1 * 4/2003 Pelrine et al. ..... 29/25.35

FOREIGN PATENT DOCUMENTS

EP 0875647 A1 * 11/1998
JP 7-223597 A * 8/1995
JP 11-152009 A * 6/1999

OTHER PUBLICATIONS

Beer, F. P., Johnston Jr., E. R. *Mechanics of Materials* Chapter 4, Pure Bending, pp 150–161, 1981.

* cited by examiner

*Primary Examiner*—Chuck Y. Mah
(74) *Attorney, Agent, or Firm*—Derrick Michael Reid

(57) ABSTRACT

A conductive hinge is made of a superelastic shape memory alloy such as nitinol (NiTi) having a large elastic strain limit for enabling the hinge to bend around a small radius during stowage and flexible return to a trained rigid hinge position. The hinge is conductive enabling use of the hinge as a conductor for routing power through multiple solar cell panels interconnected by the hinges forming a hinged solar cell array that is deployed when the hinges are released from the bent stowed configuration to the rigid deployed configuration when the hinges further function as latches to lock the panels in place.

14 Claims, 6 Drawing Sheets

PICOSAT SIDE VIEW

PICOSAT FRONT VIEW

STOWED ARRAY

MEMORY ALLOY HINGE

FLAT NITINOL HINGE

SCALLOPED NITINOL HINGE

DEPLOYED HINGE

STOWED HINGE

NITINOL SUPERELASTIC STRESS-STRAIN CURVE

CLOSED LATCH

OPENED LATCH

LOCKED LATCH

METHOD OF DEPLOYING SHAPE MEMORY ALLOW HINGED PANELS

CONDUCTIVE SHAPE MEMORY METAL DEPLOYMENT LATCH HINGE

REFERENCE TO RELATED APPLICATION

The present application is related to applicant's application entitled "Power Sphere", Ser. No. 09,520,120, filed Mar. 6, 2000.

The present application is related to applicant's copending application entitled "Conductive Shape Memory Metal Deployment Latch Hinge Deployment Method", Ser. No. 09/886,417, filed Jun. 21, 2001.

FIELD OF THE INVENTION

The invention relates to the field of metallurgy and metal alloy mechanical hinges. More particularly, the present invention relates to shape memory alloys trained as hinges for compressed stowing and recoiled deploying of three-dimensional enclosure of panels.

BACKGROUND OF THE INVENTION

The development of microsatellites and nanosatellites low earth orbits requires the collection of sufficient power for onboard instruments with low weight in a low volume spacecraft. Power generation methods for very small satellites of less that ten kilograms are desirable for these small satellites. Thin film solar arrays are useful power sources for small satellites. One problem faced by these low weight and low volume spacecraft is the collection of sufficient power for onboard instruments and propulsion. Body-mounted solar cells may be incapable of providing enough power when the overall surface area of a microsatellite or nanosatellite is small. Deployment of traditional planar rigid large solar arrays necessitates larger satellite volumes and weights and also requires extra apparatus needed for attitude pointing. One way to provide power to a small spacecraft is the use of roughly spherical deployable power system such as a solar powersphere that offers a relatively high collection area with low weight and low stowage volume without the need for a solar array pointing mechanism. The powersphere deployment scheme requires a deployment hinge that would move the individual hexagon and pentagon flat panels of the powersphere from a stacked configuration to an unfolded configuration where the individual panels would form a spherical structure resembling a soccer ball upon completion of the deployment sequence. The powersphere requires deployment hinges that serve to move the individual hexagon and pentagon flat panels of the powersphere from a stacked configuration to an unfolded configuration where the individual panels would form a spherical structure upon completion of the deployment sequence. Each of the panels has at least one hinge to adjacent panels. The panels should be locked into place and maintained at a precise angle relative to each connected panel to form the spherical shape. The flat hexagon and pentagon panels approximate an omnidirectional sphere. A combination of hexagon and pentagon shaped panels are used to form a soccer ball panel configuration when fully deployed. The interconnecting deployment hinges serve to position the individual flat panels of the powersphere from a stacked configuration to the deployed position forming the sphere of solar panels. The panels are hinged to one another and deploy to a precise angular position into the final shape that is preferably spherical rather than oblong or some other undesirable shape. Ideally this deployment mechanism would be fabricated from a thin film material that would have the properties to effect the mechanical positioning deployment and serve as structural elements for holding and locking each of the panels in respective positions about the powersphere.

Another type of microsatellite having an power enclosure uses a powerbox that is a three-dimensional solar array shape having rectangular shaped flat panels that would also deploy from a stowed flat configuration into a box shape configuration. The powerbox consists ideally of similarly shaped panels interconnected with hinges fabricated from a thin material that would have the properties to perfect the mechanical deployment and also be a structural element for locking each of the panels into respective positions. Hence, the powerbox would also require hinges that serve to move and lock the flat solar panels into position during deployment. Regardless of the final exterior shape of the three-dimensional power enclosure of a nanosatellite or microsatellite, a hinge mechanism is needed for deployment of the flat solar panels to cause the transition from the stowed configuration to the desired final array shape. Hence, there exists a need for positioning hinges between the flat panels forming a power collecting enclosure formed from the deployed solar array flat panels to realize any number of complex three dimensional solar array exterior surfaces used for solar power collection. However, the interconnecting hinges present a power conduction problem of routing collected converted power from the flat solar array panels to the payload of the spacecraft. Electrical conductivity of the hinge could be used to route signals and power about the power enclosure without the use of separate power lines for communicating power from the solar cell panels to the spacecraft payload. The hinges should be made of conventional materials. The hinge material could be a polymer as a flexure type hinge. But polymers are unstable and relax by cold flowing when stressed for any length of time. Polymer materials can also have undesirable outgassing properties and are generally not good electrical conductors. Polymer materials also have very low Young's moduli that reduces the deployment energy that can be stored in the hinge while stowed and later used to deploy and position the panels. Spring metals such as hardened stainless steel, beryllium copper or phosphorous bronze are commonly used as flexure type spring hinges. These spring metals have large Young's moduli, low outgassing characteristics, good electrical conductivity and will not cold flow, but spring metals have very small maximum elastic strains of 1% or less, and hence are unsuitable as deployment hinges because the steel spring hinges with interconnected panels will not stow compactly. These and other disadvantages are solved or reduced using the invention.

SUMMARY OF THE INVENTION

An object of the invention is to provide a deployment hinge for interconnecting and deploying panels from a stowed configuration into a deployment configuration.

Another object of the invention is to provide a deployment conductive hinge for mechanically and electrically interconnecting and deploying solar cell panels from a stowed configuration into a deployment configuration.

Yet another object of the invention is to provide an integral deployment latch for locking deployed panels into a deployment configuration.

Still another object of the invention is to provide a conductive deployment latching hinge for mechanically moving and locking and electrically interconnecting panels into a deployment configuration forming a power enclosure of a satellite.

Yet another object of the invention is to provide a compact hinge for interconnecting thin film solar panels, for enabling the panels to be stowed compactly, and for unfolding the panels into a large area three-dimensional array of a predetermined shape.

A further object of the invention is to store the energy necessary within an interconnecting hinge for unfolding and deploying the thin film solar array panels into a three-dimensional shape.

Still a further object of the invention is to use the hinges as the conductors for daisy chaining thin film solar cell panels together for conducting electrical power from the panels to a satellite power system.

Yet a further object of the invention is to provide an integral latch hinge for locking deployed panels in place for stiffening and strengthening a panel structure.

The invention is directed to a conductive hinge and latch for mechanically and electrically interconnecting and deploying panels into a deployed configuration. In a first aspect, the conductive hinge is made of a shape memory alloy with superelastic material properties enabling a small radius bend during stowage and flexible recoil return to a trained rigid hinge deployment position. In a second aspect of the invention, the hinge is further adapted into a latch for holding the hinge in a locked position after release and recoiling to rigidly locked panels into the deployment configuration. In a third aspect, the hinge is an electrical conductor enabling the hinge to function as a power bus for routing current through multiple interconnected panels to a power system the satellite payload. The hinge is sufficiently conductive enabling the use of the hinge as a solar array power bus.

The multiple panels may be thin film flexible solar cell panels forming a hinged solar cell array that is deployed when the hinges are released from the bent stowed position into the latched rigid deployed position. Thin film solar cell arrays use extremely thin film amorphous silicon active materials. Hence, the hinge is also made equally thin as a thin film material. In order to stow thin film solar cell arrays in the most compact manner, the hinge is made of an extremely flexible superelastic shape memory alloy. To minimize the stowing volume, the hinges should be made as small as possible and the hinge will allow the panels to lie flat on top of each other.

The shape memory metal deployment hinge is preferably used for the square and rectangular solar panels forming a powerbox solar cell array, but can be used for other interconnected solar cell panel arrays such as the powersphere comprising hexagon and pentagon flat solar cell panels. The flat panels that make up a thin film deployable solar array enclosure are preferably stowed in the stack during the launch phase of a space satellite. Once on orbit, the stack of flat panels is deployed using the stored energy in the hinges so that the panels take a predetermined shape such as a rectangular powerbox or spherical powersphere. The hinge is capable of supplying the mechanical energy required to cause the stowed stack of flat panels to move and unfurl, that is recoil, to the deployed position.

The shape memory deployment metal hinge is preferably a thin sheet nitinol (NiTi) alloy used as a deployment spring, a structural support and a locking latch. Thin sheets of the nitinol alloy can be used as a spring and can be bent around extremely small radius without breakage or permanent deformation. The shape memory alloy hinge is disposed between adjacent thin film solar cell panels and can be bent to a small radius enabling the panels to stack one on top of the other with minimal spacing and therefore with maximum stowage efficiency. When stowed, the panels preferably rest on each other with no space in between the panels in order to be less susceptible to launch vibration damage and for stowage volume efficiency. The shape memory metal alloy returns when released to a trained precise angle required for the connection of the panels into the predetermined three-dimensional shape without sliding parts.

The hinge is a thin sheet of metal that maintains the correct angle and distance between adjacent solar cell panels when the array of panels is deployed. When the array is stowed, the metal is bent, that is flexed, within elastic limits. This stowage flexing stores energy that is later used to unfold the array after launch when the array is released. The hinge is a flexure type device that passively stores the energy required for deployment. After release, the hinges guide the panels during deployment and then maintains the desired deployment configuration once deployed. Thin sheets nitinol can bend around an extremely small radius without permanent deformation. When nitinol is raised in temperature to above the shape memory alloy transition training temperature, the nitinol will return to the trained configuration. When the trained sheet is released, the sheet springs back to the original shape. The on-orbit satellite releases the compressed stack of thin film panels that then unfold driven by the energy stored in the hinges located on the edges of each panel. To aid in rigidly holding the panels in place after deployment, the hinge is adapted to include an integral locking latch to hold the panel in the deployment configuration.

The shape memory metal alloy is formed as a thin film hinge structure that is simple in shape and easy to manufacture. The thin sheets of the nitinol alloy can be forged to provide the required precise final angle required to place each of the flat panels of the powersphere or powerbox into the deployment position. The superelastic shape memory alloy hinge is extended to include the function of a latch that locks the deployed structure in place for improved strength, and further functions as an electrical bus that conducts current from the solar cell panels to the payload of the satellite. Incorporating the stowage, deploying, latching and conductive functions in a single hinge element, the complexity and cost of the array is reduced, and the assembly process is simplified with improved reliability. These and other advantages will become more apparent from the following detailed description of the preferred embodiment.

DETAILED DESCRIPTION OF THE PREFERRED EMBODIMENT

Figure 1A:
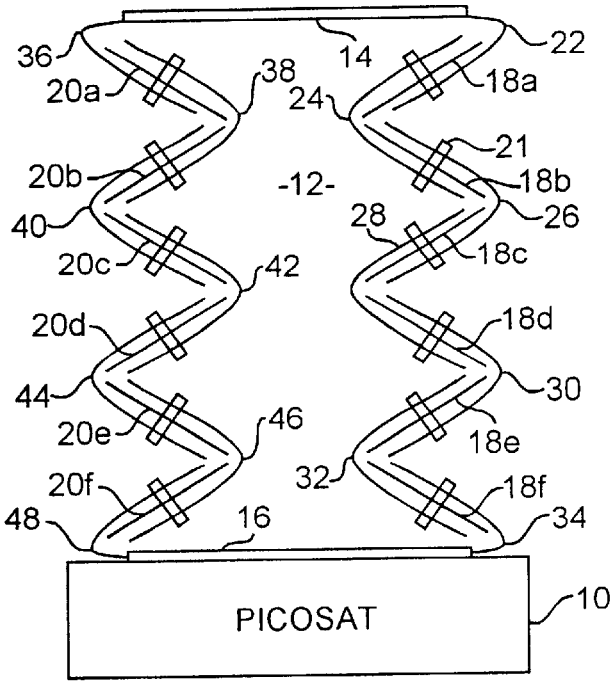
FIG. 1A is a front view of a picosatellite having a deployed solar cell array.
Figure 1B:
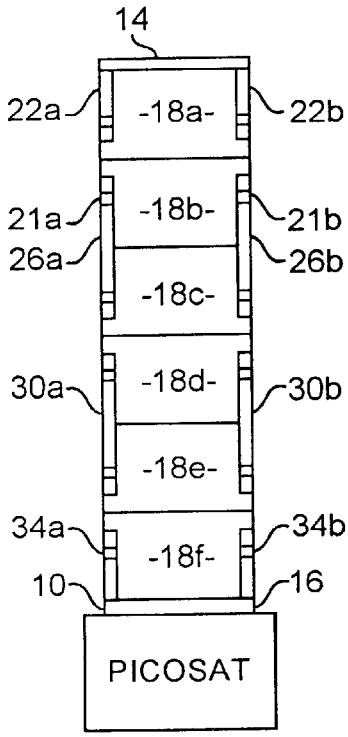
FIG. 1B is a side view of the picosatellite.
Figure 2:
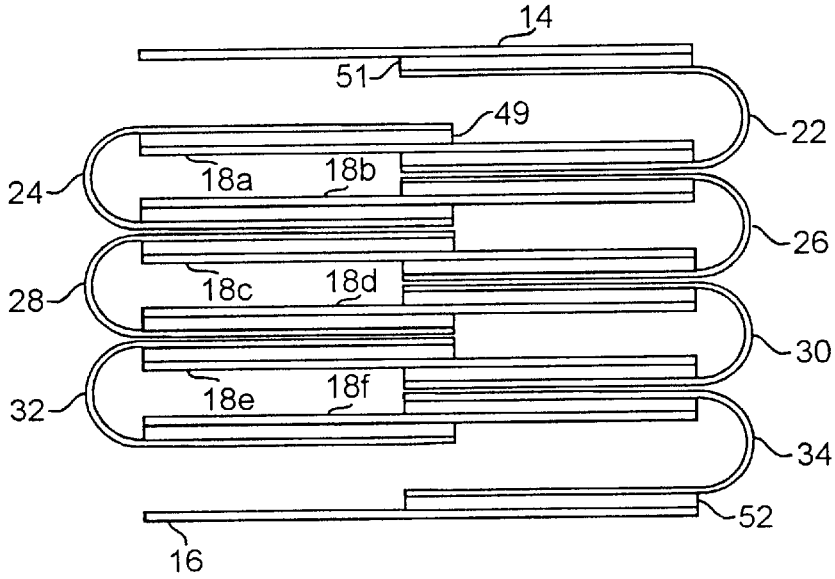
FIG. 2 depicts a memory alloy hinge having a small bend radius during stowage.

An embodiment of the invention is described with reference to the figures using reference designations as shown in the figures. Referring to FIGS. 1A, 1B and 2, a picosatellite 10 has a powerbox 12 including a top 14 and bottom 16. The powerbox 12 is formed by a plurality of rectangular panels including right side panels 18*a*, 18*b*, 18*c*, 18*d*, 18*e*, and 18*f*, collectively referred to as panels 18 and including left side panels 20*a*, 20*b*, 20*c*, 20*d* and 20*f*, collectively referred to as panels 20. For convenience, only the right and left sides of the powerbox 12 are shown, but it is understood that the powerbox 12 may further include identical front and back sides of panels, not shown. The right side panels 18 are interconnected together and to the top 14 and the bottom 16 by hinge pairs 22, 24, 26, 28, 30, 32 and 34, also respectively shown as hinges 22*a* and 22*b*, 24*a* and 24*b*, 26*a* and 26*b*, 28*a* and 28*b*, 30*a* and 30*b*, 32*a* and 32*b*, and 34*a* and 34*b*. The panels 18*a* and 20*a* are respectively connected to the top 14 by hinge pairs 22 and 36, and panels 18*f* and 20*f* are respectively connected to the bottom 16 by hinge pairs 34 and 48. As shown, the powerbox 12 is almost completely unfolded from a compact accordion-like stowed configuration into a final deployment shape during accordion expansion and unfurling of the panels 18 and 20 during deployment of the powerbox 12 from the picosatellite 10. The thin film solar panels 18 and 20 do not bend, but remain flat, during stowage and deployment.

Each of the adjacent thin film solar panels 18 and 20 are interconnected by two strip hinges, for example, panels 18*b* and 18*c* are interconnected by hinges 26*a* and 26*b*, that is, hinge pair 26. To improve the electrical conductivity, the hinge can be plated at its ends with a metal of high conductivity such as silver. The silver plating is not applied to the shape memory alloy hinge in the bend area. One hinge is attached to the positive contact and another attached to the negative contact located on respective sides of the thin film solar panels. The hinges alternate between the active side, i.e. outward facing from the box, such as hinges 22, 26, 30, and 34 and the inactive side, inward facing from the box, such as hinges 24, 28, and 32 of the thin film solar panels. This is necessary for mechanical success of accordion folding. To maintain electrical conductivity between the hinges in order to form a power bus down to the satellite power management system, conductive jumpers are used to electrically connect the active side hinge with the inactive side hinge. For example, jumper 21*a* provides continuity between hinges 24*a* and 26*a*. All hinge and jumper connections are done by electrically conductive solder. The hinges are interconnected by conductive jumpers, a pair of which is jumper pair 21, one of which is jumper 21*a* electrically interconnecting hinge 26*a* and the other of which is jumper 21*b* electrically interconnecting hinge 26*b*. The hinges are interconnected to the jumpers that may be metal clips for electrically connecting together one hinge on one active side of a panel to another hinge on the other inactive side of the panel. The panels 18 and 20 are secured to each other by conductive solder joints, one of which is shown as joint 49, and secured to the top 14 and bottom 16 by respective solder joints 51 and 52, respectively. When released, the panels 18 and 20 unfurl and accordion expand from a compressed stacked configuration to form a rigid box shape of the powerbox 12.

Figure 3:
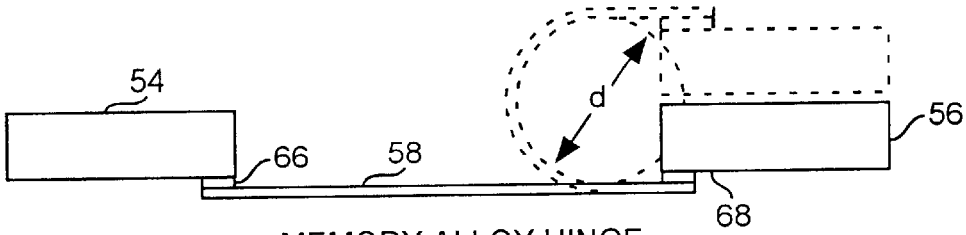
FIG. 3 depicts a memory alloy hinge returning to a trained relative angle from a stowed position.
Figure 4A:
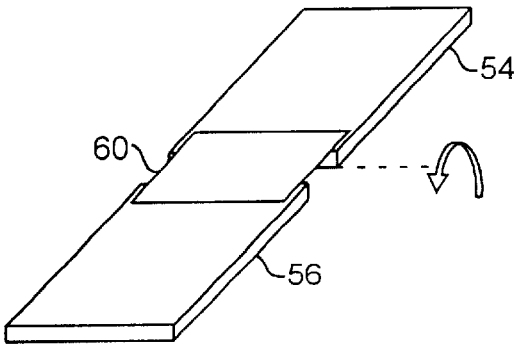
FIG. 4A depicts a flat nitinol hinge.
Figure 4B:
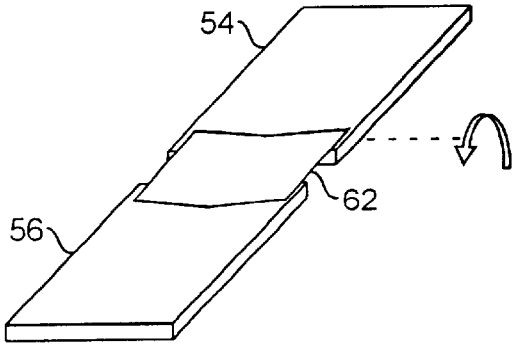
FIG. 4B depicts a scalloped nitinol hinge.
Figure 5A:
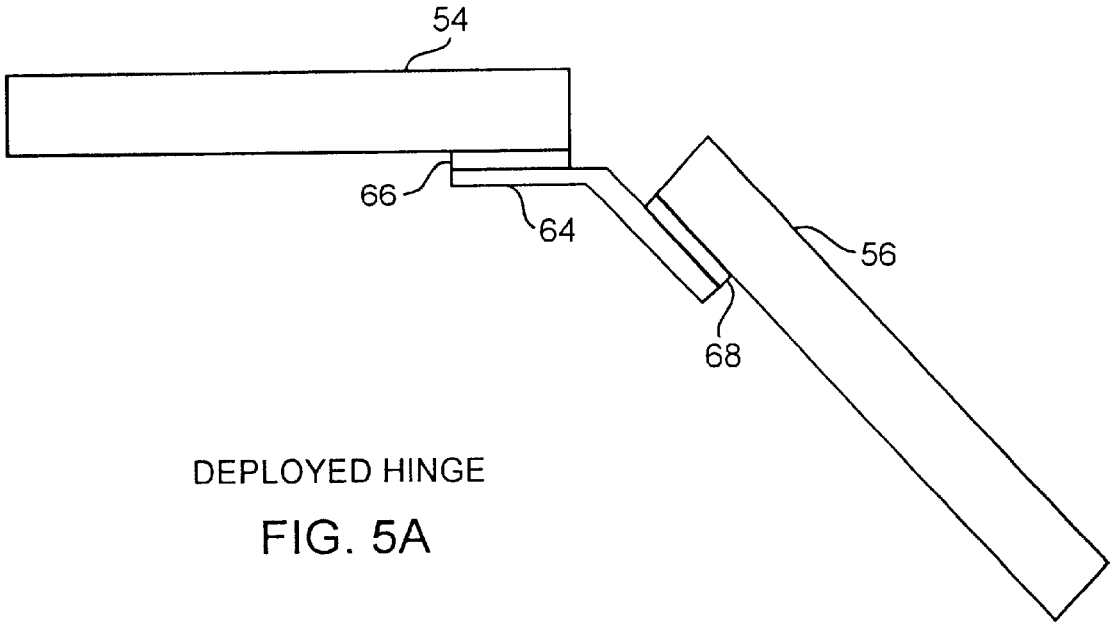
FIG. 5A depicts a deployed hinge.
Figure 5B:
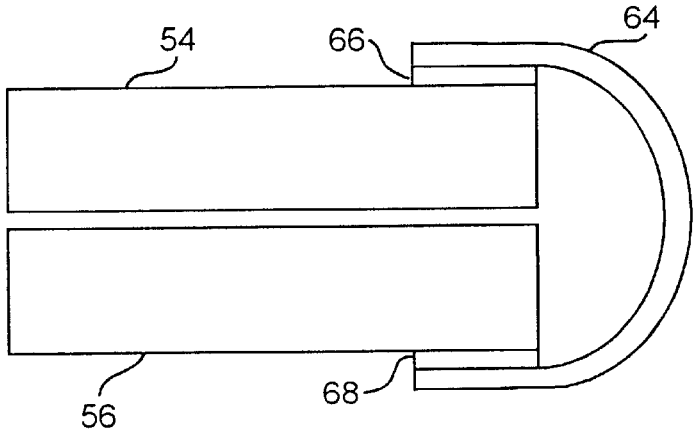
FIG. 5B depicts a stowed hinge.

Referring to FIGS. 1 through 5B, and two panels 54 and 56 when in the deployed position return to a trained relative angle, for example, of 180° as in FIG. 3, or 142° as shown in FIG. 5A. To minimize the hinge stowed diameter d, the elastic strain limit of shape memory alloys is large. A further benefit of shape memory alloys is the inherent damping that occurs within the material as it flexes. This will remove unwanted array motion following deployment or due to environment disturbance forces. Another benefit of shape memory alloy is that it is electrically conductive allowing the power generated in the solar panels connected by the hinges to be passed down through them ultimately to the satellite power management system. When in the stacked stowed configuration, all of the hinges 58 are folded to a small radius d that is preferably only slightly larger than the total thickness of the panels 54 and 56 and hinges 58, in addition to the solder joints 66 and 68, so that the panels 54 and 58 can be accordion stacked in a compressed state that minimizes stowage volume when in the stowed stacked configuration. The hinge 58 can be trained to assume several deployed shapes such as the shapes of a flat hinge 60 or a scalloped hinge 62. The scalloped hinge 62 offers increased rigid strength when released from the stowed position and fully returned to the final deployed position. That angle is arbitrary and is determined by the desired final shape of the deployed array once all the hinges are open. For the powerbox example, the trained angle is 180° because it is desired that the powerbox walls be straight. It is conceivable that the powerbox walls could be designed to bow outwards in which case the trained angle would be greater than 180°. In the case of the powersphere thin film solar array shape, the 32 panels that comprise the array have hinges between them trained to an angle of 142° in order to realize a spherical shape when all of the panels are deployed. For both the powersphere and powerbox array shapes, the stowed angle of a hinge is always 0°. Furthermore the hinge, by being soldered to the panels, holds the distance between cells fixed. This also effects the shape of the final deployed array.

The shape memory metal deployment hinge 58 can be fabricated out of 0.7 mm thick foil of nitinol (NiTi) alloy. A strip of the shape memory alloy foil may be one quarter inch wide. The strip is disposed in a mold, not shown, that is then heated to approximately 500° C. and forged over the mold to train the foil to the relative angle between the two panels 54 and 56. The NiTi alloy foil in the fixture would together then be quenched in order to cause the NiTi alloy to permanently have the relative angle as shown for example in FIG. 5A. The two panels 54 and 56 are bonded or soldered to the NiTi alloy foil strip completing the hinge assembly. The hinge 58 can then be folded back on itself to form a zero degree fold of the hinge so that the panel 54 and 56 are parallel to each other for compressed stacking during stowage.

A hinge 58 is a flexure hinge that is made as a very thin planar sheet. The hinge 58 should have a large maximum elastic strain limit, for example of up to 8%, a bending axis for zero-power deployment utilizing the energy stored in the elastic strain when stowed. The hinge 58 also offers damping of oscillations of the hinge due to the hysteresis in the stress-strain cycle. The hinge 58 is electrically conductive for routing power from the interconnected panels 54 and 56. Also, the formed angle of any hinge 58 can be independently determined from hinge to hinge to form an arbitrary enclosed volume or surface of panels that are preferably flat panels 54 and 56.

Referring to FIGS. 1A through 6, nitinol has a maximum elastic strain limit that may be as high as 8%. The maximum elastic strain determines the smallest bend diameter of the stowed flexure hinge 58. A nitinol hinge will stow thin film solar cells with improved packaging efficiency. The nitinol flexure hinge allows for a slow deployment of a structure. The rate of deployment can be further controlled by ohmically heating the hinge when conducting power through the hinge. Deliberate heating for subsequent actuation is not needed when the hinge is used above the shape memory alloy transition temperature or used as a power bus conducting power that will slowly warm the hinge to control the deployment rate. Hence, the nitinol hinge can be used as a hinge between the panels as well as an electrical bus to conduct the power. As that current passes through the nitinol hinge, the resistive losses cause the hinge to heat to deploy the panel at a predetermined rate. The flexure hinge of very thin nitinol material allows the most efficient packaging of thin film solar cells for a deployable array. The hinge can be configured for intricate arrays because no elaborate pulley mechanisms are required. That is, each panel unfolds under power of the stored energy in the flexing hinge.

Figure 6:
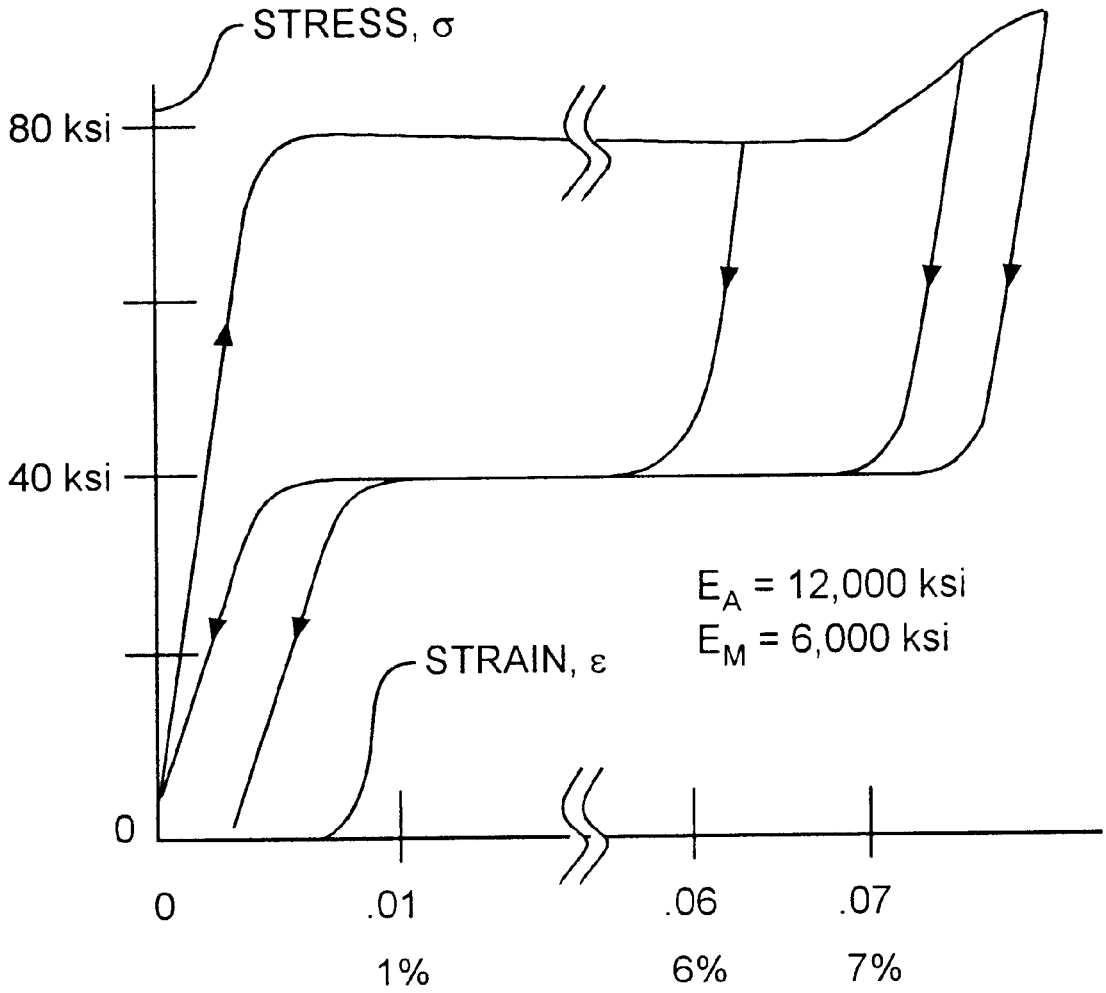
FIG. 6 is a graph of a nitinol superelastic stress-strain curve.
Figure 7A:
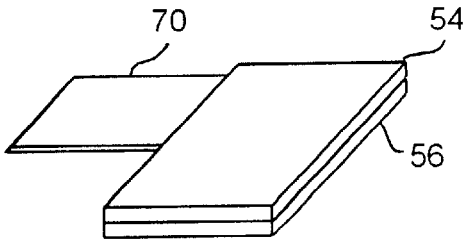
FIG. 7A depicts a closed latch.
Figure 7B:
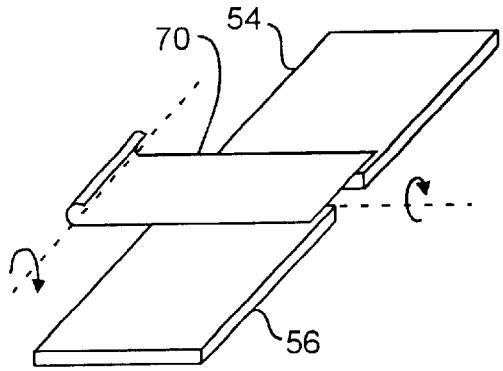
FIG. 7B depicts an open latch.
Figure 7C:
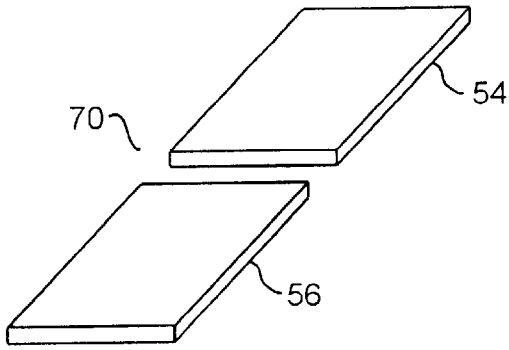
FIG. 7C depicts a locked latch.

Referring particularly to FIG. 6, superelastic shape memory alloys have an elastic strain region that is elongated as shown. Initially, the stress is proportional to the strain. However, at a point where the elastic strain limit of a nonsuperelastic metal is reached, the shape memory alloy performs a reversible crystal structure phase change. As a result, the elastic strain limit $\epsilon_m$ is shifted substantially along the deformation strain axis, for example, to almost 8% for NiTi in tension. Practically, the 8% is only valid for one superelastic tension cycle of the metal. When more cycles are required, the maximum operating strain should be reduced, for example, for one hundred cycles, a maximum tensile strain of 6% may be used. The nitinol NiTi alloy ratio used is 55.8% Ni and has a transformation temperature $A_f$=0° C. As long as the temperature of the alloy is above $A_f$, then the material will exhibit stress-strain behavior bounded by the stress-strain curve. In the open position, the hinge moves precisely to the desired final angle. The inside bend diameter d is related to the deformation strain of the material and the thickness of the material. That is, $d=t(1-\epsilon)/\epsilon$ where $\epsilon$ is the deformation strain of the material and t is the thickness. A diameter of d=0.016 inches is sufficient to package a double-sided thin film solar cell array in accordion stowage, where each cell is 0.010 inches thick. However, it is not small enough for the single-sided thin film solar cell array where each cell is 0.006 inches thick. For this, a NiTi sheet even thinner than t=0.001 inches will be needed in order that the array will efficiency stow with the panels in abutting each other in planar contact.

Referring to all of the figures and more particularly FIGS. 4B, 7A, 7B and 7C, a second aspect of the invention is the latch hinge. The scallop hinge 62 and the coil hinge 70 function as both a hinge and a latch. The scallop hinge 62 has a first hinge axis defining a stowage bend, and a second latch axis defining the scallop bend, and as such, the scallop hinge 62 is a form of the latch hinge 70, unfolding about two different axes. The coil hinge 70 also has a first hinge axis defining the stowage bend and a second latch axis defining a coil bend. The coil latch 70 functions by rolling up and forming a coil whose axis is orthogonal to the hinge stowage axis and thereby prevents any further hinge angular motion once the latch fully coils. The latch 70 is integral to the hinge because a latch portion is formed by cutting the shape memory alloy sheet used for the hinge so that the hinge foil has a tab 70 that can coil. That tab is trained to roll up to a coil when the hinge is deployed. In the stowed position the coil is unrolled and folded to the same radius as the hinge, thereby preventing latching during stowage. The hinge function is characterized as having a traverse bend with the hinge axis of bending orthogonal to the aligned interconnected panels 54 and 56. The latch function is characterized as having a longitudinal bend with the latch axis of uncoiling parallel with the aligned interconnected panels 54 and 56. The hinge and latch axes of bending need only be at a different orientation from each other to add strength to the hinge to lock the panels in place. In the preferred form, the hinge bending axis is orthogonal to the latch coil axis. The latch hinges 62 and 70 firstly unbend along the traverse hinge axis to angularly position the panels 54 and 56 relative to each other. The latch hinges 62 and 70 then unbend along the longitudinal latch axis to lock the panels in place at that relative angular position. The scallop hinge 62 is characterized by having a longitudinal scallop bend and the coil hinge is characterized by having a longitudinal coil bend.

Figure 8:
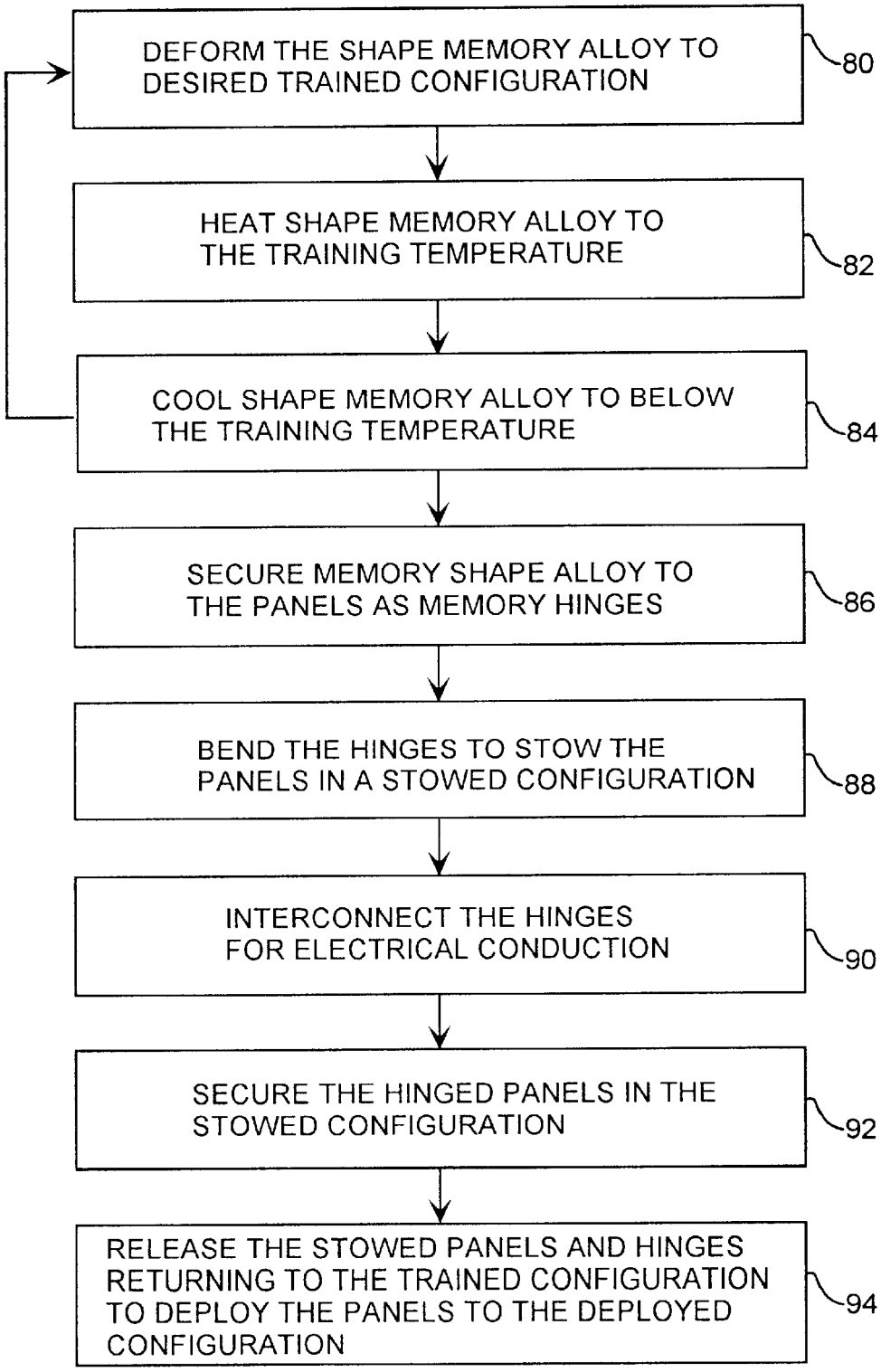
FIG. 8 decits the method of deploying shape memory alloy hinged panels.

Referring to FIG. 8, in forming the hinges, a suitable sized hinge is placed in a fixture, not shown, and raised to a training temperature 80 through the crystal transition phase. When the material is placed in fixture and strained, stress forces are created in the material. The stress forces are relieved when the material is heated to the training temperature. The fixture can be a mold that holds the hinge when deformed 82 into the desired shape with the desired bend angle when the shape memory alloy material is in the austeutit phase. The material is then quenched and cooled down 84 to below the training temperature so as to complete the training of the material. Many shape memory alloy hinges are needed so that steps 80 through 84 are repeated a number of times to train several hinges. The hinges are secured to the panels by bonding and or soldering or both. Then, the hinges are forcibly folded and elastically strained as the panels are folded into the stowed configuration, and, held in the stowed configuration so as to store potential energy for subsequent return to the trained configuration after release. The hinges will return to the trained configuration when released dissipating the potential energy during hinge unfolding motion. The hinges may be further interconnected together, using electrical jumpers for example in the case of conducting collected solar power. The hinged panels are then secured in the stowed position for subsequent release. The securing means may be a fuse wire that is opened when desired. The hinged panels are then released with the hinges returning to the trained configuration as the panel move to and are latched into the deployed position.

The construction of an interconnected thin film solar cell panels can be made in any two-dimensional shape. Thin film cells are very flexible when constructed around a thin polyimide core. Using monolithic interconnects, cells can be partitioned and connected in series thereby raising the voltage seen at the contacts. The back side of the cells is electrically isolated with both electrical contacts located on the same side as an active region. The next step in constructing the rectilinear array is to build the array in z-folds. First, the rectangular thin film solar cells are laid out in a row. The silver plated superelastic NiTi alloy strips are soldered to the contacts on the front side of each end of the solar cells. The unplated bent hinge regions of the strips are aligned with the gap between adjacent cells. Next, the jumpers are installation interconnecting the strips. Adjacent hinges are on opposite sides of the solar cell panel. The alternating opposite side displacement of the hinges prevents any hinge from being located on the inside of a bending fold. The hinges are located on the outside of each bend. While this preserves the integrity of the mechanical hinge, it fragments the electrical bus of interconnecting hinges. Thus, very thin jumpers of copper or silver foil are installed to electrically connect the hinges together for continuity as a power bus. The final step is the connection of top and bottom z-folded panels to the top and bottom of the picosatellite stowing the array. A fuse wire, not shown, can be used to hold the panels in the stowed configuration and subsequently fired for releasing the hinges.

The present invention is directed towards memory shape alloy latch hinges for interconnecting, power distributing, deploying, and latching solar cell panels forming a power source, but can generally be applied to any set of panels desired to be interconnected for forming a contiguous surface. Those skilled in the art can make enhancements, improvements, and modifications to the invention, and these enhancements, improvements, and modifications may nonetheless fall within the spirit and scope of the following claims.

What is claimed is:

1. A hinge for moving two panels from a stowed position to a deployed position for forming a hinged surface, the deployed position being defined by a trained angle between the two panels, the panels conducting electrical current, the hinge comprising, a bending portion made of a shape memory alloy, the shape memory alloy is conductive for conducting the electrical current between the two panels, the bending portion trained to the trained angle, and opposing first and second edges made of the shape memory alloy respectively coupled to and between the two panels for securing the panels to each other, the bending portion and two opposing edges and two panels for forming the hinged surface, the panels for conducting the electrical current through the shape memory alloy of the opposing edges and bending portion, the opposing edges being joined to the bending portion disposed between the opposing first and second edges, wherein the bending portion is trained to the deployed position for defining the deployed position of the panels forming the hinged surface, the bending portion for bending about a hinge axis for placing the two panels in the stowed position, the bending portion for unbending about the hinge axis for deploying the two panels into the deployed position for forming the hinged surface having the trained angle.

2. The hinge of claim 1 wherein, the shape memory alloy is nitinol, and the panels are solar panels.

3. The hinge of claim 1 further comprising, a conducting plating for increasing the conductivity of the shape memory alloy.

4. The hinge of claim 1 wherein, the hinge axis extends through the bending portion, the bending portion is made of the shape memory alloy that is trained, the opposing edges are flat, and the opposing edges are made of the shape memory alloy that is untrained.

5. The hinge of claim 1 wherein, the hinge axis extends through the bending portion, the bending portion is made of the shape memory alloy that is trained, the bending portion can be bent 180 degrees so that the two panels are parallel when in the stowed position, the bending portion unbends from the bent 180 degrees to the trained angle when the unbending from the stowed position to the trained position, the bending portion unbends to the trained angle when the two panels are in the deployed position, the opposing edges are flat, and the opposing edges are made of the shape memory alloy that is untrained.

6. The hinge of claim 1 wherein, the hinge axis extends through the bending portion, the bending portion is made of the shape memory alloy that is trained, the bending portion can be bent 180 degrees so that the two panels are parallel when in the stowed position, the bending portion in the stowed position defining a diameter being less than 0.016 inches as a distance between the opposing first and second edges, the bending portion unbends from the bent 180 degrees to the trained angle when the unbending from the stowed position to the trained position, the bending portion unbends to the trained angle when the two panels are in the deployed position, the opposing edges are flat, and the opposing edges are made of the shape memory alloy that is untrained.

7. The hinge of claim 1, wherein the electrical current conducting between the two panels and through the bending portion and opposing first and second edges serves to heat the bending portion of the hinge when the two panels are in the stowed position and for raising a temperature of the bending portion to above a training temperature for unbending to the bending portion for positioning two panels into the deployed position.

8. The hinge of claim 1,wherein the hinge axis extends through the bending portion, the bending portion is made of the shape memory alloy that is trained, the bending portion can be bent 180 degrees so that the two panels are parallel when in the stowed position, the bending portion unbends from the bent 180 degrees to the trained angle when the unbending from the stowed position to the deployed position, the bending portion unbends to the trained angle when the two panels are in the deployed position, the opposing edges are flat, and the opposing edges are made of the shape memory alloy that is untrained, and the electrical current conducting between the two panels and through the bending portion and opposing first and second edges serves to heat the bending portion of the hinge when the two panels are in the stowed position and for raising the temperature of the bending portion to above a training temperature for unbending to the bending portion for positioning two panels into the deployed position.

9. The hinge of claim 1 wherein, the bending portion is trained to the trained angle when bent to the trained angle and heating to above a training temperature.

10. The hinge of claim 1 wherein, the bending portion is frozen when below a transformation temperature.

11. The hinge of claim 1 wherein, the bending portion unbends to the trained angle when above the transformation temperature and below the training temperature.

12. The hinge of claim 1 wherein, the electrical current is conducted through the opposing first and second edges and through the bending portion is the stowed position, the electrical current serving to heat the bending portion to raise a temperature of the bending portion from below a freezing transformation temperature to above the freezing transformation temperature and below a training temperature, and the electrical current serving to heat the bending portion into a temperature range between the transformation temperature and the training temperature wherein the bending portion unbends along the hinge axis.

13. The hinge of claim 1, wherein, the shape memory allow is nitinol having a nitinol alloy ratio of 55.8% Ni.

14. The hinge of claim 1, wherein, the shape memory alloy is nitinol having a transformation temperature of 0° and having a training temperature of 500° C.

* * * * *